US007744253B2

(12) United States Patent
Engel

(10) Patent No.: US 7,744,253 B2
(45) Date of Patent: Jun. 29, 2010

(54) BUILT-IN LIGHT

(75) Inventor: Hartmut S. Engel, Monrepos Strasse 7, Ludwigsburg (DE) 71634

(73) Assignee: Hartmut S. Engel, Ludwigsburg (DE)

( * ) Notice: Subject to any disclaimer, the term of this patent is extended or adjusted under 35 U.S.C. 154(b) by 74 days.

(21) Appl. No.: 10/541,444

(22) PCT Filed: Nov. 24, 2004

(86) PCT No.: PCT/EP2004/013335

§ 371 (c)(1),
(2), (4) Date: Jun. 9, 2006

(87) PCT Pub. No.: WO2005/066537

PCT Pub. Date: Jul. 21, 2005

(65) Prior Publication Data

US 2006/0245178 A1 Nov. 2, 2006

(30) Foreign Application Priority Data

Dec. 23, 2003 (DE) ..... 103 60 947

(51) Int. Cl.
*F21V 7/00* (2006.01)

(52) U.S. Cl. ..... 362/297; 362/145; 362/147; 362/362; 362/364; 362/365; 362/366; 362/367; 362/368; 362/404

(58) Field of Classification Search ..... 362/297, 362/145, 147, 404, 364–368, 362
See application file for complete search history.

(56) References Cited

U.S. PATENT DOCUMENTS 4,088,883 A * 5/1978 Dey ..... 362/263
5,060,120 A * 10/1991 Kobayashi et al. ..... 362/465
5,682,131 A 10/1997 Gow
6,371,621 B1 4/2002 Le Bel
6,561,670 B1 * 5/2003 Jongewaard et al. ..... 362/147
2002/0024815 A1 2/2002 Haenen et al.
2002/0064047 A1 5/2002 Stauner et al.

FOREIGN PATENT DOCUMENTS

CN 2122310 11/1992
DE 2747346 4/1979
DE 3826676 A1 2/1989
DE 4336023 A1 4/1995
DE 4443916 C1 5/1996

(Continued)

OTHER PUBLICATIONS

Chinese Office Action of Application No. 200480004389.1, dated Mar. 14, 2008.

(Continued)

*Primary Examiner*—Sandra L O'Shea
*Assistant Examiner*—Mary Zettl
(74) *Attorney, Agent, or Firm*—Gifford, Krass, Sprinkle, Anderson & Citkowski, P.C.

(57) ABSTRACT

The invention relates to a built-in lamp comprising a holder for fastening in an installation surface, in particular in a room ceiling, a bulb and a reflector, with a reflector opening disposed in the direction of illumination defining a direct light discharge region and with the direct light discharge region being surrounded by a diffuse light discharge region.

16 Claims, 4 Drawing Sheets

FOREIGN PATENT DOCUMENTS

Figure 1:
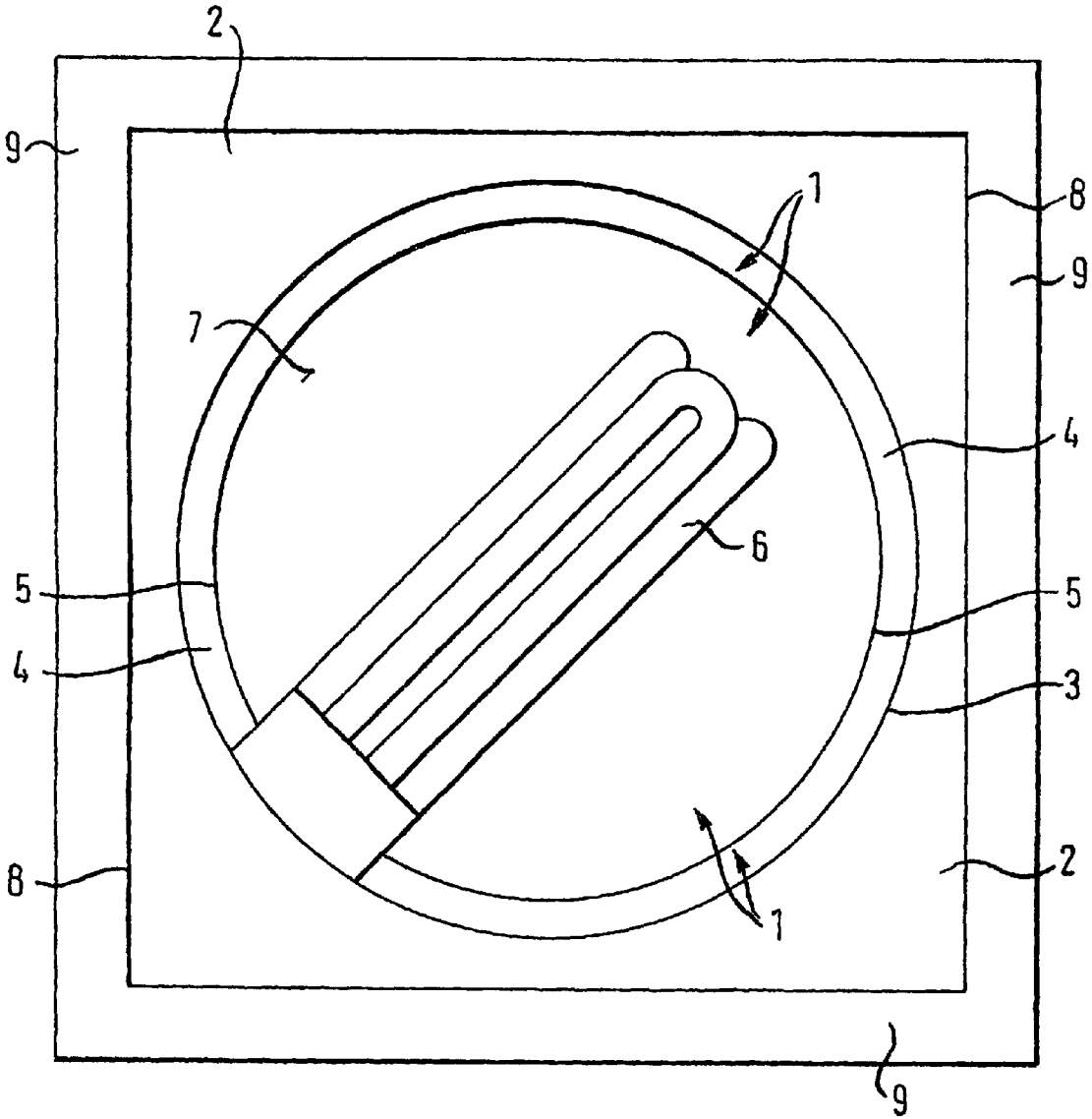

| | | | | |
|---|---|---|---|---|
| DE | 19507333 | A1 | | 9/1996 |
| DE | 20021730 | U1 | * | 3/2001 |
| DE | 20119022 | U1 | | 4/2002 |
| DE | 10112055 | A1 | | 10/2002 |
| DE | 10151958 | A1 | | 4/2003 |
| DE | 20310475 | U1 | | 10/2003 |
| EP | 0359069 | | | 3/1990 |
| EP | 0648971 | | | 3/1994 |
| EP | 1033530 | A2 | | 6/2000 |
| EP | 0678700 | A1 | | 4/2002 |
| FR | 2135928 | | | 12/1972 |
| GB | 548117 | | | 9/1942 |
| GB | 1102270 | | | 2/1968 |

OTHER PUBLICATIONS

DeQi's English Translation of the First Office Action Text of Application No. 200480004389.1.

* cited by examiner

BUILT-IN LIGHT

The invention relates to a built-in lamp comprising a holder for fastening in an installation area, in particular in a room ceiling, a bulb and a reflector, with a reflector opening disposed in the direction of illumination defining a direct light discharge region.

Built-in lamps of this kind are known from the prior art in a variety of forms. Dark-light lamps are known, among others, in which the bulb and the reflector are arranged with respect to one another such that the bulb cannot be seen on the reflector either directly or in reflection from a specific angle of view and thus cannot develop any glare effect. This avoidance of a glare effect, however, also results in the ceiling region of a room illuminated in this manner remaining largely non-illuminated and in the relationship between the light source and the illuminated region perceived as natural by a person being lost, since it cannot be recognized from which light source the light originates.

This effect is alleviated in accordance with the prior art in that a partly or completely frosted glass plate is secured in the region of the reflector opening disposed in the direction of illumination or beneath it in order to hereby generate diffuse light. However, the portion of the directed, direct light is thus partly or completely reduced, which is in turn disadvantageous.

Furthermore, built-in lamps are known from the prior art which likewise avoid the aforesaid effect. With these built-in lamps, scattering reflectors, for example white reflectors are used instead of specularly reflecting reflectors. These scattering reflectors have the effect that the light source or its illuminated reflector becomes visible at practically all angles of observation, albeit with a disadvantageous glare effect again occurring.

An object of the invention consists of further developing a built-in lamp of the initially named kind such that, on the one hand, a glare effect is avoided in accordance with the dark-light principle and such that, on the other hand, it is ensured that the persons located in the illuminated room can perceive the light sources used for the illumination consciously or even unconsciously such that a natural relationship is created between the light source and the illuminated region and a warm room climate is obtained in a technical lighting manner.

In accordance with the invention, the object is satisfied by the features of claim 1 and in particular in that the direct light discharge region is surrounded by a non-glare diffuse light discharge region. In accordance with the invention, it is therefore possible to work in accordance with the dark-light principle in the direct light discharge region and the advantages resulting therefrom can be utilized, with scattered light, however, simultaneously being discharged from the diffuse light discharge region in accordance with the invention around the direct light discharge region, with the luminance of said scattered light being able to be selected such that no glare effect occurs. A visible marking of the light source is thus always ensured, which results in a room mood perceived as pleasant with a good light atmosphere despite the use of the dark-light principle. In addition, a generation of softer shadows and an advantageous general room brightening is additionally achieved by the scattered light being discharged through the diffuse light discharge region in accordance with the invention.

In addition to these advantages, interesting design possibilities result from the diffuse light discharge region in accordance with the invention, for example by an individual choice of the shape of the diffuse light discharge region or of the color of the discharged scattered light.

It is advantageous for the direct light discharge region and the diffuse light discharge region to be acted on by a common bulb, since no separate bulb has to be provided for the diffuse light discharge region in accordance with the invention in this manner. No additional bulb costs thus arise with respect to built-in lamps known from the prior art and a change of the bulb can also take place with the same effort as with already known built-in lamps.

In accordance with a preferred embodiment of the invention, the reflector opening defining the direct light discharge region can be associated with a direct light reflector on whose side remote from the direct light discharge region an additional reflector or background reflector is provided which acts both on the direct light discharge region and on the diffuse light discharge region. With an arrangement of this kind, the bulb radiates direct light into the actual direction of illumination via the direct light reflector, on the one hand, and in a direction opposite to the direction of illumination toward the additional reflector, on the other hand, which deflects some of the light incident on it in the direction of the diffuse light discharge region and some of the light to the direct light discharge direction in dependence on its design such that this additional reflector also contributes to the increase in efficiency in the generation of direct light. This additional reflector can reflect either in a specularly reflecting manner or in a diffuse manner, with a conversion from directly reflected light being able to take place in the scattered light in the region of the diffuse light discharge region in the first-named case.

It is preferred for a light passage region to be formed between the additional reflector and the direct light reflector such that the additional reflector can deflect that portion of the light which should correspond to the diffuse light portion past the outer side of the direct light reflector to the diffuse light discharge region.

The diffuse light region can be acted on both via the additional reflector and directly via the bulb, with it, however, being of advantage for this action to take place only indirectly via the additional reflector.

The additional reflector can be formed from at least one planar or suitably shaped reflector surface. As already mentioned, this reflector surface can be made either to be specularly reflecting or diffusely reflecting. The ratio of the light portions which are deflected to the direct light discharge region and to the diffuse light discharge region can be directly adjusted by a suitable curvature or kinking of the additional reflector. To achieve a high efficiency of the built-in lamp in accordance with the invention, the additional reflector is shaped such that a high light portion moves to the direct light discharge region and only a small light portion moves to the diffuse light discharge portion.

It is particularly advantageous for the bulb and the direct light reflector to be arranged in a housing whose inner surface is made at least regionally as an additional reflector. When a housing of this kind which is open in the direction of illumination is used, the housing base can in particular be made as a planar or suitably curved or kinked reflector surface which forms at least one region of the additional reflector. The side walls of a housing of this kind can also be made to be specularly reflecting or diffusely reflecting and can thus act as further reflector regions. When the housing base or the housing side walls are formed as an additional reflector, it is achieved in an advantageous manner that no additional components are required for this reflector. It is only necessary to equip the housing with the respectively desired reflection behavior on the inner side. In the simplest case, a metal housing can be used which is untreated with respect to it surface and which has inherent specularly reflecting properties. It is alternatively also possible, for example, to coat the inner side of the housing with a white lacquer whose particle size can be selected such that the respectively desired reflection behavior results.

It is advantageous with respect to the housing for it to be made light-proof, since in this case, for example, imprecisions in the finishing are not illuminated from behind in an unintended manner with suspended ceilings. The housing can furthermore be made dust-proof in order thus to counter contamination of the bulb and reflectors caused, for example, by air-conditioning systems.

The direct light reflector is preferably made to be specularly reflecting on its inner side just like the reflectors of known built-in lamps in order to achieve a defined illumination characteristic and good efficiency. On its outer side, the direct light reflector can be made to be specularly reflecting or diffusely reflecting so that the light acting on the diffuse light discharge region can also be guided over the outer side of the direct light reflector. The outer side of the direct light reflector in this case forms a region of the additional reflector or background reflector.

The bulb of a built-in lamp in accordance with the invention can be located either inside the direct light reflector and/or between the direct light reflector and the additional reflector. It is ensured with these arrangement possibilities of the bulb that the bulb can act both on the direct light reflector and on the additional reflector.

The diffuse light discharge region can be terminated in the direction of illumination by a translucent scattering plate. This is in particular appropriate when the additional reflector is made to be specularly reflecting since in this case the diffuse light discharge region is acted on by directly reflected light which can be converted into diffuse light by means of the named scattering plate.

It is particularly advantageous for the housing of the built-in lamp in accordance with the invention to be terminated in at least a largely dust-proof manner by the scattering plate in the region of the diffuse light discharge region and by a plate which is in particular transparent in the region of the direct light discharge region. In this manner, a frequent cleaning of the direct light reflector and of the additional light reflector as well as of the bulb can be avoided since the named plates form reliable protection against dust.

The transparent plate associated with the direct light discharge region and the translucent scattering plate associated with the diffuse light discharge region can in particular be made in one piece. A one-piece plate of this kind then only has to be treated differently in its surfaces associated with the direct light region and the diffuse light region so that the plate has a transparent effect in the direct light discharge region and a scattering effect in the diffuse light discharge region.

The direct light discharge region can preferably have a circular shape, or also any other desired shapes. The direct light discharge region can in particular also have an elongated shape so that a use of the built-in lamp in accordance with the invention as a surface luminaire becomes possible.

The diffuse light discharge region can be bounded on the inner side by the outer contour of the direct light discharge region, in particular by a circular line. The diffuse light discharge region can have any desired shape on the outer side. It is preferred for the diffuse light discharge region to be bounded on the outer side by a polygonal line, in particular by a rectangular or square line, or by a further circular line.

The direct light reflector can be held pivotably in the housing in accordance with a further embodiment of the invention such that the primary direction of illumination fixed by the direct light reflector can be adjusted. Advantageous design effects can hereby be achieved; it in particular becomes possible to give a plurality of built-in lamps in accordance with the invention, which are used in common as a system, a uniform appearance independent of which angular position the pivotable direct light reflector has relative to the housing. It is important in this process that the diffuse light region ensures a visible marking of the light source with the advantages resulting therefrom in an unchanged manner even with a pivotable direct light reflector.

By a pivoting of the direct light reflector, the direct light discharge region and the diffuse light discharge region can be inclined jointly with respect to the installation area in a manner such that they are substantially located within a common plan inclined with respect to the installation area in their inclined position.

Alternatively, an inclination of the direct light discharge region with respect to the diffuse light discharge region can be achieved by a pivoting of the direct light reflector, whereas the diffuse light discharge region has an unchanged position relative to the housing.

In order to ensure the respectively desired illumination characteristics in every angular position of the pivotable direct light reflector, the direct light reflector can be held pivotably in the housing jointly with the bulb.

Figure 2:
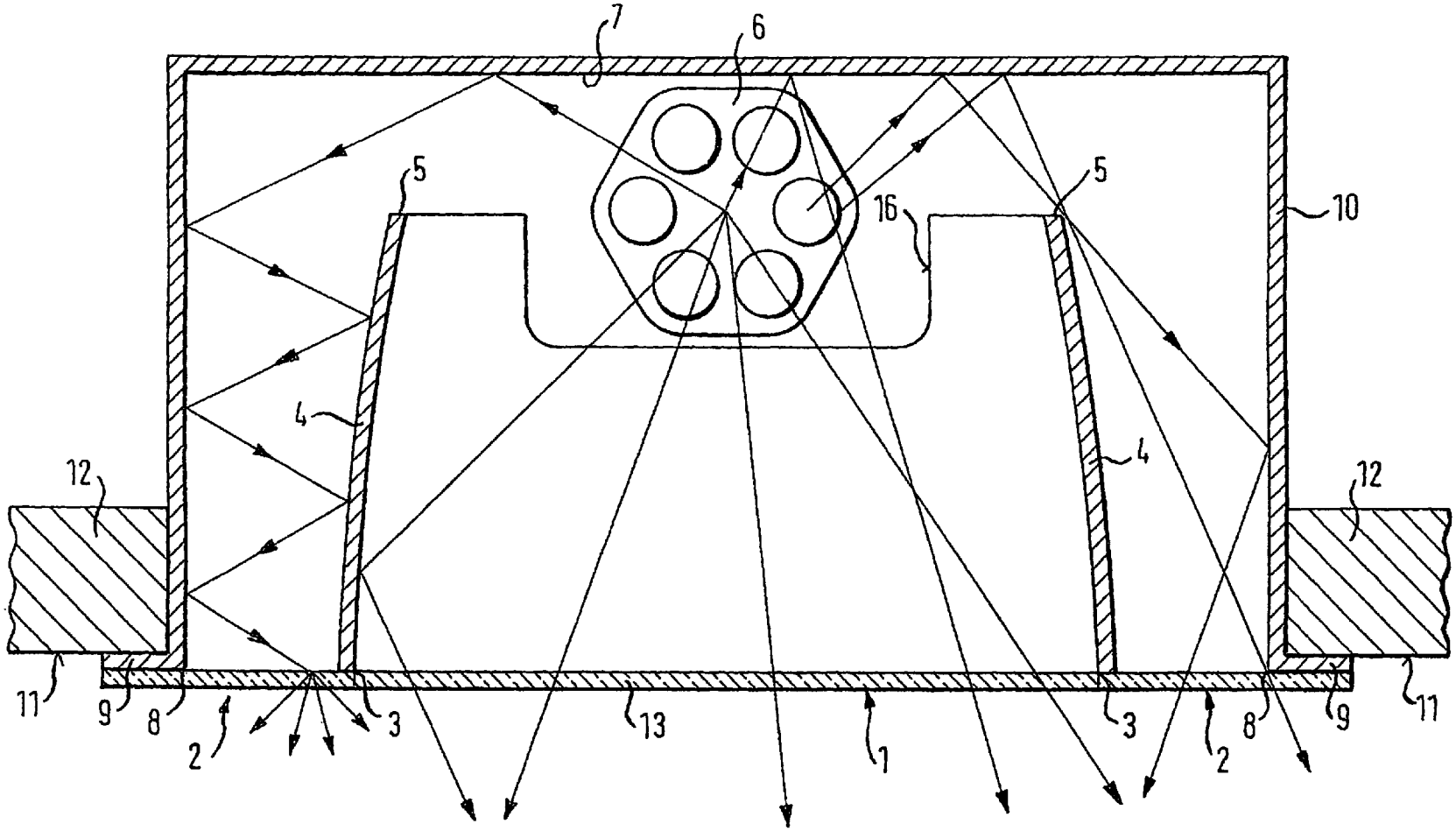
Figure 3:
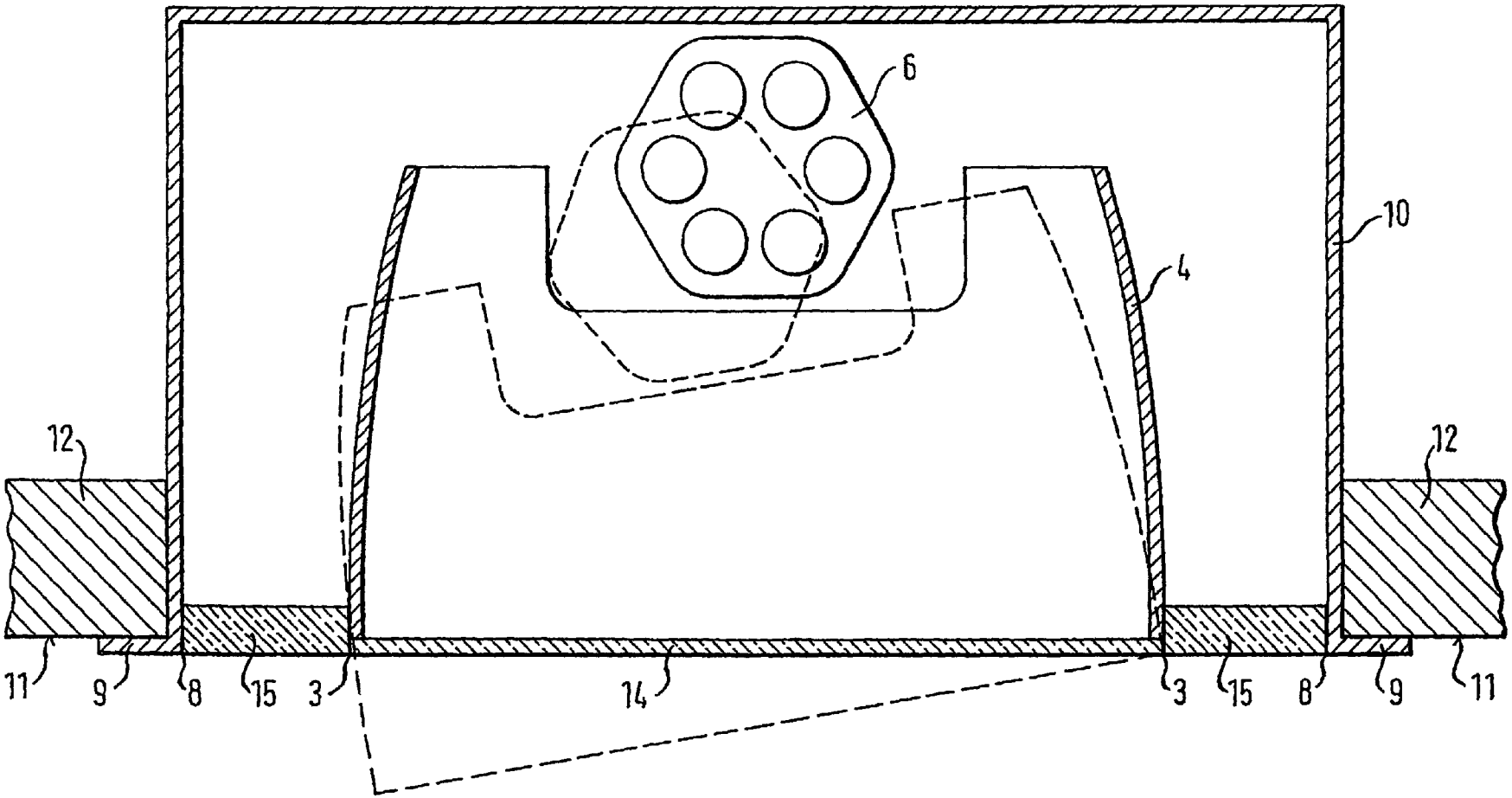
Figure 4:
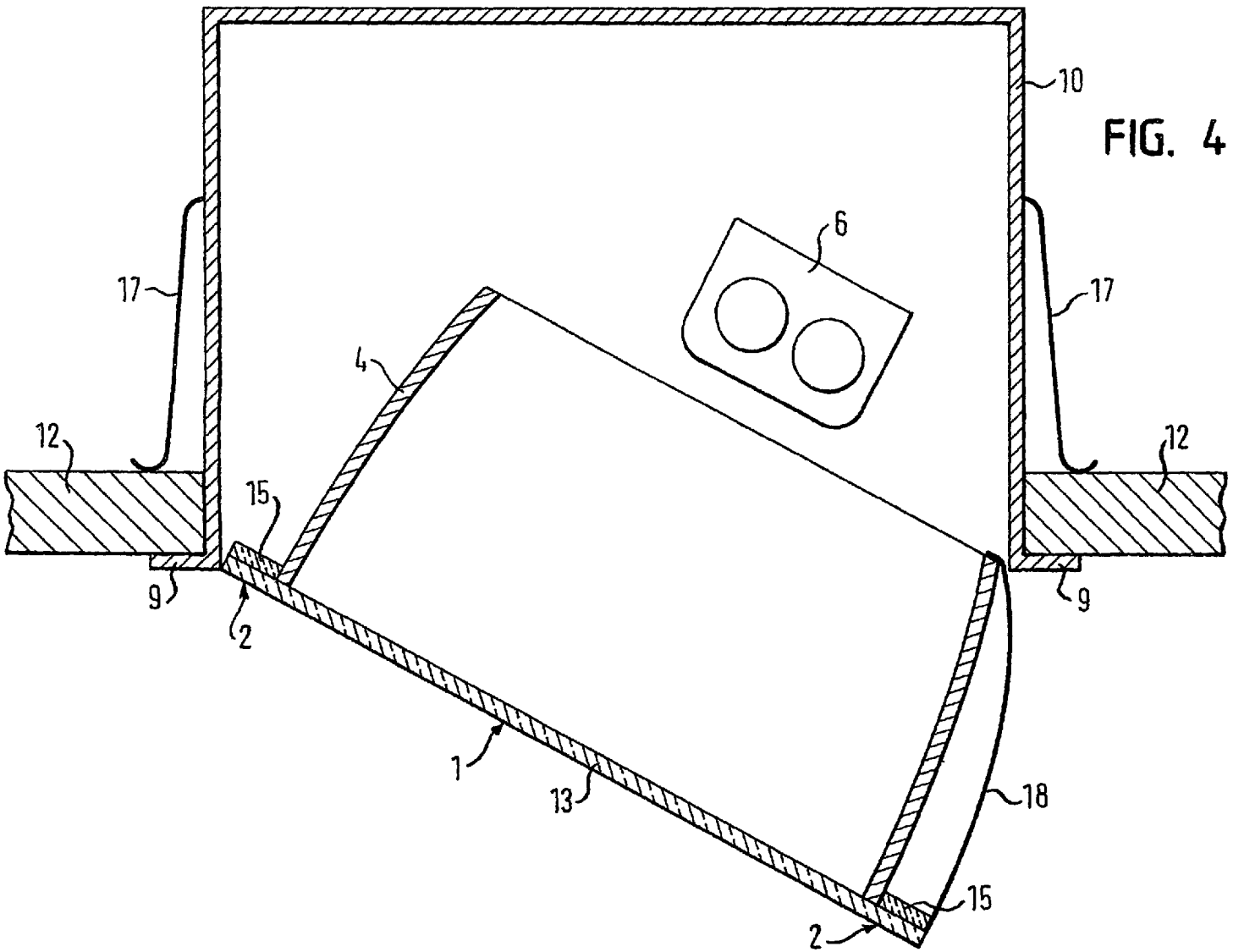

Further preferred embodiments are described in the dependent claims. The invention will be described in the following with reference to embodiments and to the drawings. There are shown in these:

FIG. 1 a plan view of a built-in lamp in accordance with the invention;

FIG. 2 a schematic cross-section through a built-in lamp in accordance with the invention in accordance with FIG. 1;

FIG. 3 a schematic cross-section through a built-in lamp in accordance with the invention in accordance with a further embodiment; and FIG. 4 a schematic cross-section through a built-in lamp in accordance with the invention in accordance with an additional embodiment.

FIG. 1 shows a built-in lamp in accordance with the invention in a plan view which has a direct light discharge region 1 and a diffuse light discharge region 2 surrounding it. The direct light discharge region 1 is bounded at its outer periphery by a circular line 3 which at the same time represents the inner boundary of the diffuse light discharge region 2.

The direct light discharge region 1 extends in the plane of the drawing in the same plane as the opening of a direct light reflector 4 which is disposed in the direction of illumination and which likewise extends along the circular line 3. The direct light reflector 4 extends into the drawing plane up to a rear reflector opening which is disposed opposite to the direction of illumination and which is bounded by a circular line 5. The circular line 5 extends concentrically to the circular line 3 with a radius reduced with respect to the circular line 3.

A bulb 6 is arranged inside the direct light reflector 4 and is designed as a compact fluorescent lamp.

An additional reflector or background reflector 7 is provided behind the direct light reflector 4 extending into the plane of the drawing and extends in a plane parallel to the plane of the drawing in the example shown. The relative arrangement of the direct light reflector 4, the bulb 6 and the additional reflector 7 will be explained in more detail in the following with reference to FIG. 2.

The diffuse light discharge region 2, which is bounded by the circular line 3 on the inner side, is bounded on the outer side by a square line 8, which in turn forms the inner boundary of a frame 9 of the built-in lamp shown. The side of the frame 9 remote from the direction of illumination contacts an installation surface (not shown), in particular a room ceiling and thus, together with the built-in lamp held in the frame 9, covers an opening present in the installation surface provided for the reception of the built-in lamp.

On the operation of the bulb 6, direct light moves from the bulb 6 to the direct light discharge region 1, with the direct light discharge region 1 being acted on directly by the bulb 6, on the one hand, and by the light reflected at the direct light reflector 4 and at the additional reflector 7, on the other hand. This light being discharged via the direct light discharge region 1 ensures the actual illumination desired using the built-in lamp shown with the respectively required illumination characteristics and the desired efficiency.

Light furthermore moves from the bulb 6 via the additional reflector 7 to the diffuse light discharge region 2 from which it is discharged as scattered light. This scattered light then effects the initially mentioned marking of the direct light discharge region 1 typical for built-in lamps in accordance with the invention.

FIG. 2 shows a schematic cross-section through a built-in lamp in accordance with FIG. 1, with the same reference numerals being used here as in the explanation of FIG. 1.

The built-in lamp shown has a housing 10 substantially of parallelepiped shape which is open in the direction of illumination and which has the peripheral frame 9 at its open side. As already explained in connection with FIG. 1, the side of the frame 9 remote from the direction of illumination contacts an installation surface 11 which is formed, for example, by the lower side of a suspended ceiling element 12.

The direct light reflector 4 is attached inside the housing 10 and has a first opening in the direction of illumination which coincides with the direct light discharge region 1. At its end remote from the direct light discharge region 1, the direct light reflector 4 has a further opening which faces the base of the housing 10 and from which some of the light amount radiated from the bulb 6 can be discharged from the direct light reflector 4 opposite the direction of illumination in the direction of the housing 10. The direct light reflector 4 has a shape which tapers in the direction of the base of the housing 10 and has a cut-out 16 at its end remote from the direct light discharge region 1 in order to provide space for the fitting of the bulb 6.

The base of the housing 10 forms a region of the additional reflector 7. Further regions of the additional reflector 7 are formed by the side walls of the housing 10 and by the outer side of the direct light reflector 4.

The housing 10 is terminated at its open side facing the region to be illuminated by a plate 13 which has different optical properties in different regions. The plate is made completely transparent in the direct light discharge region 1 so that light coming from the bulb 6 can pass through this plate region without impediment. In the diffuse light discharge region 2, in contrast, the plate 13 is made as a scattering plate which scatters light incident on it from the inner side of the housing and thus generates diffuse light. The region of the scattering plate extends up to the outer edge of the frame 9 so that the frame 9 is covered by the scattered light region of the plate 13.

Alternatively, in a more cost-favorable variant, the scattered light region of the plate 13 can also be designed as a ring element having apertures, in particular as a perforated metal sheet with a small perforation size, with it being advantageous in this case for the direct discharge region not to be made closed by means of a plate, but to be made open.

In FIG. 2, three light rays originating from the bulb 6 are shown which are directly incident onto the transparent region of the plate 13 from the bulb 6 and which, due to the transparency of the plate 13, pass through it without impediment. A further light ray, likewise only shown by way of example in FIG. 2, is incident from the light source 6 onto the specularly reflecting inner side of the direct light reflector 4 from where the light ray is again deflected through the transparent region of the plate 13. An additional light ray, again only shown by way of example in FIG. 2, is incident from the light source 6 at an acute angle onto the additional reflector 7 from where the light ray is likewise deflected through the transparent region of the plate 13.

Light rays of the named kind, which pass through the transparent region of the plate 13 and thus through the direct light discharge region 1 provide the room illumination desired with the built-in lamp in accordance with the invention.

Some of the light supplied by the bulb 6 also moves into the light passage region formed between the direct light reflector 4 and the base of the housing 10 so that it can move to the diffuse light discharge region 2 by simple or multiple reflection. A light ray moving to the diffuse light discharge region 2 under multiple reflection is likewise drawn by way of example in FIG. 2. This light ray is incident at a less acute angle, starting from the bulb 6, onto the base of the housing 10 and is reflected from there to the side wall of the housing 10. A multiple reflection subsequently takes place between the named side wall of the housing 10 and the specularly reflecting outer side of the direct light reflector 4 until the light ray is ultimately incident onto the region of the plate 13 made as a scattering plate. This scattering light region ensures that the light ray is converted into diffuse light which is discharged from the diffuse light discharge region and marks the direct light discharge region 1 in the manner already explained. The same applies accordingly to the two light rays in accordance with FIG. 2 which only move to the diffuse light discharge region 2 under reflection at the housing base or by reflection at the housing base and simple reflection at the side wall of the housing.

The solid lines of FIG. 3 show a built-in lamp in accordance with the invention which is identical with the built-in lamp in accordance with FIG. 2 except for the following differences.

Unlike FIG. 2, the built-in lamp in accordance with FIG. 3 is not terminated by a one-piece plate 13. Instead, the opening of the direct light reflector 4 disposed in the direction of illumination is terminated by a transparent plate 14 which does not extend beyond the outer periphery of the direct light reflector 4. The transparent plate 14 is surrounded by a scattering plate 15 which is bounded on the inner side by the circular line 3 in accordance with FIG. 1 and on the outer side by the square line 8 in accordance with FIG. 1. A substantial difference to the built-in lamp in accordance with FIG. 2 accordingly consists of the fact that the housing 10 is terminated by a two-part plate 14, 15 in the direction of illumination.

A further substantial difference with respect to FIG. 2 consists of the fact that the direct light reflector 4 is supported movably, in particular pivotably, together with the bulb 6 in the housing 10. It is, for example, possible to bring the direct light reflector 4 together with the bulb 6 into the position shown by a broken line in FIG. 3, which has the consequence that the direction of illumination of the direct illumination no longer extends in a perpendicular manner, but now extends inclined to the installation surface 11. The named pivot movement extends around an axis which extends parallel to the installation surface 11 and which forms any desired tangent to the circular line 3 in accordance with FIG. 1.

Despite the pivotability of the direct light reflector 4 and of the bulb 6, the scattering plate 15 remains unchanged in its position, that is it continues to extend parallel to the installation surface 11. This results in a uniform, advantageous appearance of an arrangement of a plurality of built-in lamps in accordance with the invention, and indeed also when the direct light reflector 4 is only pivoted in individual built-in lamps or when the direct light reflector 4 is pivoted in different directions in different built-in lamps. It is again important in this process that the already explained marking function of the scattered light regions is maintained unchanged.

FIG. 4 shows a schematic cross-section through a built-in lamp in accordance with the invention in which the direct light reflector 4 is held pivotably in the housing 10.

The built-in lamp in accordance with FIG. 4 also has a housing 10 substantially of parallelepiped shape which is open in the direction of illumination and which has a peripheral frame 9 at its open side. At its outer side, the housing 10 is provided with resilient clamps 17 which serve for the fixing of the housing 10 in a ceiling element 12.

The direct light reflector 4 provided in the housing 10 is supported pivotably in the housing 10 together with a bulb 6, with the pivot movement being able to take place around an axis which extends along a side of the housing 10 of parallelepiped shape adjoining the frame 9.

At is lower side, the direct light reflector 4 is terminated by a transparent plate 13 which extends beyond the outer edge of the direct light reflector 4 disposed in the direction of illumination, and indeed so far that it is suitable to completely cover the open side of the housing 10 in a non-pivoted position of the direct light reflector 4. A scattering plate 15 which extends parallel to the plate 13 and which is suitable to convert direct light into diffuse light is provided in the transparent plate 13 in the total region on the inner side of the housing disposed outside the direct light reflector 4.

On the side remote from the pivot axis, the direct light reflector 4 and the plate 13 are provided with a viewing shell element 18 which can be pivoted out of the housing 10 together with the direct light reflector 4 and the plate 13 and which forms a surface visible on the room side in this position. The outer side of the direct light reflector 4, the inner side of the viewing shell element 18 and the scattering plate 15 include a volume through which a light portion is directed which is ultimately provided for the purpose of passing through the scattering plate 15. To achieve this, the inner side of the viewing shell element 18, just like the outer side of the direct light reflector 4, can be made to be reflecting. It is, however, likewise possible to design the viewing shell element 18 as transparent or as a diffuser plate such that diffuse light is not only discharged from the built-in lamp in accordance with the invention through the scattering plate 15, but also through the viewing shell element 18 The light optionally being discharged through the viewing shell element 18 can then serve for the brightening of the ceiling element 12.

Analog to FIGS. 2 and 3, the light portion ultimately provided for the room illumination is discharged from the inner region of the direct light reflector 4 through the transparent plate 13. The region of the plate 13 affected by this thus forms the direct light discharge region 1. That light portion which, however, passes through the scattering plate 15 and subsequently through the transparent plate 13 is responsible for the generation of the scattered light portion in accordance with the invention. This scattered light portion passes through the diffuse light discharge region 2 which surrounds the direct light discharge region 1.

An important feature of the embodiment in accordance with FIG. 4, unlike the embodiment in accordance with FIG. 3, is that the total plate 13, including the scattering plate 15, is pivoted together with the direct light reflector 4 such that a pivoting of the plane of the direct light discharge region 1 together with the plane of the diffuse light discharge region 2 becomes possible. It is ensured despite this pivot possibility that a sufficient diffuse light portion can pass through all regions of the scattering plate 15, and optionally also through the viewing shell element 18, even in a pivoted position. If diffuse light passes through the viewing shell element 18, an advantageous ceiling brightening effect is additionally achieved.

REFERENCE NUMERAL LIST

1 direct light discharge region
2 diffuse light discharge region
3 circular line
4 direct light reflector
5 circular line
6 bulb
7 additional reflector
8 square line
9 frame
10 housing
11 built-in surface
12 ceiling element
13 plate
14 transparent plate
15 scattering plate
16 cut-out
17 clamps
18 viewing shell element

The invention claimed is:

1. A built-in lamp comprising a holder for fastening in an installation surface (11), a bulb (6) and a direct light reflector, with a reflector opening disposed in the direction of illumination defining a generally planar direct light discharge region (1), which is surrounded by a generally coplanar diffuse light discharge region (2) such that scattered light is discharged from the diffuse light discharge region (2) around the direct light discharge region (1), characterized in that the bulb (6) and the direct light reflector (4) are arranged in a housing (10), said housing having a planar inner surface which overlies the reflector and which forms an additional reflector (7) which reflects at least a portion of light from said bulb to said diffuse light discharge region; and in that the housing (10) is terminated in at least a largely dust-proof manner by a transparent planar plate extending across and covering said direct light discharge region and a planar scattering plate extending across and covering said diffuse light discharge region, said transparent planar plate and said planar scattering plate being coplanar with each other, and wherein the direct light discharge region (1) has a circular shape, and the diffuse light discharge region (2) is bounded on the inner side by a circular line (3) and on the outer side by a polygonal line or by a further circular line.

2. A built-in lamp in accordance with claim 1, characterized in that the direct light discharge region (1) and the diffuse light discharge region (2) can be acted on by a common bulb (6).

3. A built-in lamp in accordance with claim 1, characterized in that the reflector opening defining the direct light discharge region (1) is associated with a direct light reflector (4) on whose side remote from the direct light discharge region (1) an additional reflector or background reflector (7) is provided.

4. A built-in lamp in accordance with claim 1, characterized in that a light passage region is formed between the additional reflector (7) and the direct light reflector (4).

5. A built-in lamp in accordance with claim 1, characterized in that the diffuse light discharge region (2) can only be acted on indirectly by the bulb (6) via the additional reflector (7).

6. A built-in lamp in accordance with claim 1, characterized in that the additional reflector (7) is formed at least partly by at least one planar or pre-determinably curved or kinked reflector surface which ensures a pre-determinable splitting of the portion of the reflected light directed to the direct light discharge region (1) and to the diffuse light discharge region (2).

7. A built-in lamp in accordance with claim 1, characterized in that the housing (10) is made to be light-proof and/or dust-proof.

8. A built-in lamp in accordance with claim 1, characterized in that the additional reflector (7) is made to be specularly reflecting or diffusely reflecting.

9. A built-in lamp in accordance with claim 1, characterized in that the direct light reflector (4) is made to be specularly reflecting on its inner side.

10. A built-in lamp in accordance with claim 1, characterized in that the direct light reflector (4) is made to be specularly reflecting on its outer side.

11. A built-in lamp in accordance with claim 1, characterized in that the bulb (6) is located inside the direct light reflector (4) and/or between the direct light reflector (4) and the additional reflector (7).

12. A built-in lamp in accordance with claim 1, characterized in that the translucent scattering plate (13) and the plate (13), which is in particular transparent, are made in one piece.

13. A built-in lamp in accordance with claim 1, characterized in that the polygonal line is a rectangular or square line (8).

14. A built-in lamp in accordance with claim 1, characterized in that the direct light reflector (4) is held pivotably in the housing (10).

15. A built-in lamp in accordance with claim 1, characterized in that a common inclination of the direct light discharge region (1) with the diffuse light discharge region (2) is adjustable with respect to the installation surface (11) by a pivoting of the direct light reflector (4); or in that an inclination of the direct light discharge region (1) is adjustable with respect to the diffuse light discharge region (2) by a pivoting of the direct light reflector (4).

16. A built-in lamp in accordance with claim 1, characterized in that the direct light reflector (4) is held pivotably in the housing (10) together with the bulb (6).

* * * * *